US007259743B2

(12) United States Patent
Pappalardo et al.

(10) Patent No.: US 7,259,743 B2
(45) Date of Patent: Aug. 21, 2007

(54) SYSTEM FOR DRIVING COLUMNS OF A LIQUID CRYSTAL DISPLAY

(75) Inventors: Salvatore Pappalardo, Catania (IT); Francesco Pulvirenti, Acireale (IT); Salvatore Privitera, Catania (IT); Leonardo Sala, Pont Saint Martin (IT)

(73) Assignee: STMicroelectronics S.r.l., Agrate Brianza (MI) (IT)

( * ) Notice: Subject to any disclaimer, the term of this patent is extended or adjusted under 35 U.S.C. 154(b) by 445 days.

(21) Appl. No.: 10/518,614

(22) PCT Filed: Jun. 23, 2003

(86) PCT No.: PCT/EP03/06638

§ 371 (c)(1),
(2), (4) Date: Dec. 23, 2004

(87) PCT Pub. No.: WO2004/003882

PCT Pub. Date: Jan. 8, 2004

(65) Prior Publication Data

US 2005/0219191 A1 Oct. 6, 2005

(30) Foreign Application Priority Data

Jun. 27, 2002 (IT) ..... MI2004A1424

(51) Int. Cl.
*G09G 3/36* (2006.01)

(52) U.S. Cl. ..... 345/100; 345/99

(58) Field of Classification Search ..... 345/87, 345/89, 94, 95, 98, 100, 204, 211
See application file for complete search history.

(56) References Cited

U.S. PATENT DOCUMENTS 5,563,624 A * 10/1996 Imamura ..... 345/100

(Continued)

FOREIGN PATENT DOCUMENTS

EP 1 265 217 A 12/2002
WO PCT/EP 03/06638 6/2003

OTHER PUBLICATIONS

Patent Abstracts of Japan, Aug. 11, 2000, JP 2000 221926 A Sony Corp, vol. 2000 No. 11.

*Primary Examiner*—Chris Kelley
*Assistant Examiner*—Robert E. Carter, III
(74) *Attorney, Agent, or Firm*—Hogan & Hartson LLP

(57) ABSTRACT

A system for driving columns of a liquid crystal display includes logic circuitry operating in a supply path between a first and a second supply voltage in which the first supply voltage is higher than the second supply voltage. The logic circuitry is capable of generating first logic signals and second logic signals whose value is equal to the first or second supply voltage. The system includes two level shifters coupled to the logic circuitry and operating in a supply path between a third supply voltage greater than the first supply voltage and the second supply voltage; the level shifters are capable of raising the value of the second logic signals. The system also includes a first and a second pair of transistors having different supply paths and having an output terminal in common; the first and the second pair of transistors are coupled to the level shifters to determine the drive signal of a column. The system includes turnoff circuitry operating in a supply path between the third and the second supply voltage and coupled to the two level shifters. The turnoff circuitry is capable of keeping one of the two pairs of transistors in a turnoff state in the period of time of a frame when the other of the two pairs of transistors is operative.

8 Claims, 4 Drawing Sheets

U.S. PATENT DOCUMENTS 5,621,426 A * 4/1997 Okada et al. ..... 345/95
5,731,795 A * 3/1998 Kanda et al. ..... 345/87
5,859,627 A * 1/1999 Hoshiya et al. ..... 345/100
6,525,567 B2 * 2/2003 Koizumi ..... 326/82
6,897,839 B2 * 5/2005 Noguchi et al. ..... 345/82
2002/0140686 A1 10/2002 Noguchi et al.

* cited by examiner

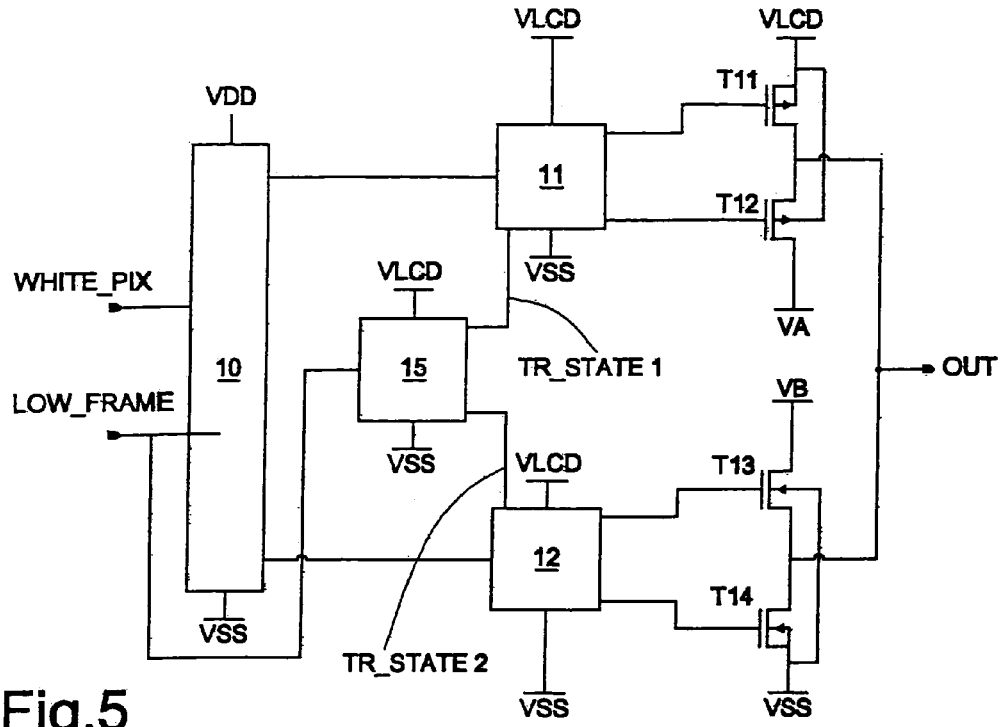
Fig.5
Fig.3
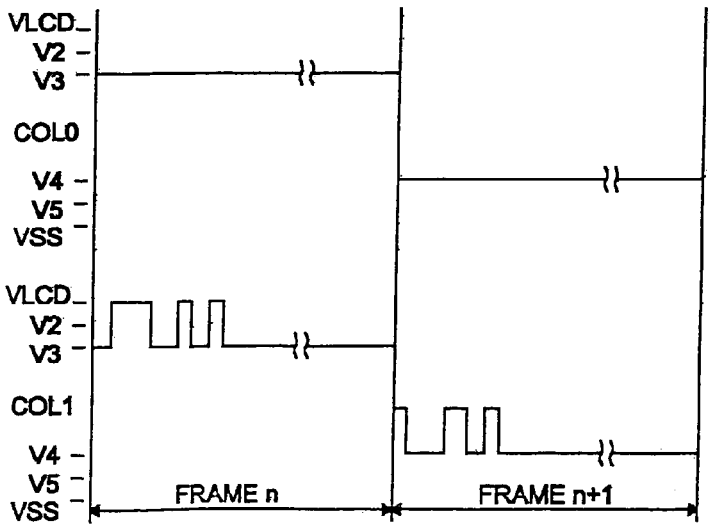
PRIOR ART
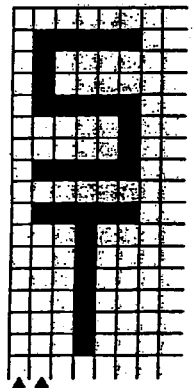
Fig.4
PRIOR ART

SYSTEM FOR DRIVING COLUMNS OF A LIQUID CRYSTAL DISPLAY

FIELD OF THE INVENTION

The present invention relates to a system for driving columns of a liquid crystal display.

BACKGROUND OF THE INVENTION

Liquid crystal displays (LCD) are used today in an ever-increasing number of products such as cellular telephones, portable computers, etc. The displays, which can be in black and white, or in a grey or color scale, are usually made up of a matrix of electrodes in rows and columns. When driven by an appropriate voltage signal, a change in the optic behavior occurs at the crossing points of the rows and columns ("pixels").

The image that is visualized on the display is obtained through different possible methods for driving the rows and the columns.

One method that is often used for driving an LCD is known as Improved Alt & Pleshko (IA&P) and requires a single row electrode to be excited for an elementary period of time by a single selection pulse and the simultaneous excitation of the column electrodes. Voltage values are then applied to the column electrodes suitable for causing all the pixels that belong to that single row to be turned on or turned off. For a successive period of elementary time there is an excitation of another row electrode and so on until the scanning of the last row electrode is completed; therefore if the row electrodes are a number N and T is the period of elementary time, the time needed for scanning all the rows will be given by NT which is also called a "frame".

The optic transmission characteristics of the liquid crystal vary with the amplitude of the voltage applied to the relative pixel, but the application of direct voltage is damaging to the liquid crystal as it permanently changes and degrades the physical properties of the material. For this reason, the voltage signals used to drive the single pixels of an LCD are alternating voltage in relation to a common value of direct voltage that is not necessarily ground potential. In this manner, the driving of a pixel of the display comes about through two waveforms of equal amplitude but with opposite polarity in relation to a common voltage, that follow each other periodically. Therefore the driving voltage applied to a given pixel during its period T within a frame is applied with opposite polarity during the respective period T of the successive frame.

Nevertheless, all these voltage transitions involve significant power that has to be managed by the drive circuits. Therefore, one of the primary purposes in planning the LCD row and column driving devices is to reduce the power consumption to minimize both the power delivered by the power supplies of said devices, and the power dissipated by them.

One part of a driving device of LCD rows and columns, more precisely the Philips PCF8548 device, is shown in FIG. 1.

The LOW_FRAME signal is a logic signal that equals zero in the even frames, and equals one in the uneven frames. WHITE_PIX is a logic signal that equals zero when the pixel is on, and equals one when the pixel is off. Starting from these two signals are generated, through a circuit 1, the control signals that drive two PMOS transistors T9, T10 and two NMOS transistors T7, T8.

In particular, the gate terminals of transistors T8, T9 and T10 are driven through 3 identical circuit cells C1, shown in FIG. 2. Said cells are level-shifters that is, buffers that convert the logic signal levels from a low voltage to a high voltage, in particular, from the supply voltage VDD to a driving voltage VLCD generated by a device (not shown in FIG. 2) comprising a booster regulator through the connection of a certain number of stages of a charge pump.

Each cell C1 comprises two NMOS transistors M22 and M23 driven by signals A and NA, the output signal of the logic circuitry 1 and the negated signal A. The source terminals of transistors M22 and M23 are coupled to the voltage VSS and the drain terminals are respectively coupled to the drain terminals of two PMOS transistors M20 and M21 on the source terminal of which the voltage VLCD is present; in addition the drain terminals of transistors M22 and M23 are coupled to the gate terminals of transistors M21 and M20. The outputs Q drive the gate of transistors T10, T9 and T8.

The gate terminal of transistor T7 is driven directly by a logic low voltage signal.

The source terminal of the transistor T9 is connected to a voltage reference VA, while the drain terminal is coupled to the drain terminal of transistor T10, whose source terminal is coupled to the voltage VLCD. The source terminal of transistor T8 is coupled to a voltage reference VB, while the drain terminal is coupled to the drain terminal of transistor T7, whose source terminal is coupled to the voltage VSS. The drain terminals of the pairs of transistor T7-T8 and T9-T10 are in common and supply the output signal OUT.

The voltages VA and VB are different levels of intermediate voltages between the voltages VLCD and VSS that are generated inside the drive device of an LCD. The relation between these levels and VLCD is chosen on the basis of the dimension of the matrix of the display according to the criteria that is shown and described below.

In particular, according to the technique of Improved Alt & Pleshko, to drive the liquid crystal display adequately, four different voltage levels intermediate between VLCD and VSS are generated inside the device. The relation between these and VLCD is set on the basis of the number of rows m of the display according to the relations:

$$VLCD,[(n+3)/(n+4)]*VLCD,[(n+2)/(n+4)]*VLCD,\ [2/(n+4)]*VLCD,\ [1/(n+4)]*VLCD,VSS)$$

with n given by $\sqrt{m}-3$.

If, for example, m=81=>n=6 in the case of a display with 81 rows the voltage levels will be:

$$VLCD\ (9/10)*VLCD\ (8/10)*VLCD\ (2/10)*VLCD\ (1/10)*VLCD\ VSS.$$

With reference to the drive circuit of FIG. 1, in the case of a drive of columns, the voltage references VA and VB are equal respectively to (8/10)*VLCD and (2/10)*VLCD. The drive is provided, for example, in the following manner: in a frame transistors T9 and T10 are turned on alternately, while transistors T7 and T8 are off; in this case the output signal OUT, suitable for driving a column, varies between VLCD and VA according to whether the corresponding pixel on the matrix of rows and columns given at the crossing point of the column and the row is on or not. In the successive frame transistors T7 and T8 are turned on alternately while transistors T9 and T10 are off and therefore the output signal varies between VSS and VB according to whether the pixel at the crossing point of the corresponding column and row is on or not. The waveforms of the output signal OUT in the case of driving two columns COL0 and COL1 for a frame n and for the successive frame n+1 are shown in FIG. 3. FIG. 4 shows the image as it appears on the display.

What is desired is a system for driving columns of a liquid crystal display that has lower current consumption in comparison to known prior art devices.

SUMMARY OF THE INVENTION

According to an embodiment of the present invention, a system for driving columns of a liquid crystal display includes logic circuitry operating in a supply path between a first and a second supply voltage with first said supply voltage higher than said second supply voltage, said logic circuitry being capable of generating starting from first logic signals in input second logic signals in output whose value is equal to said first or second supply voltage, elevator devices coupled to said logic circuitry and operating in a supply path between a third supply voltage greater than said first supply voltage and said second supply voltage, said elevator devices being capable of raising the value of said second logic signals, a first and a second pair of transistors having different supply paths and having an output terminal in common, said first and second pairs of transistors being associated to said elevator devices and to said logic circuitry so as to determine the drive signal of a column, wherein there are two elevator devices and each of them is coupled to one of said pairs of transistors, and includes turnoff circuitry coupled to said two elevator devices, said circuitry being capable of keeping one of the two pairs of transistors in the turnoff state in the period of time of a frame when the other of said two couples of transistors is operative.

BRIEF DESCRIPTION OF THE DRAWINGS

The characteristics and the advantages of the present invention will appear evident from the following detailed description of an embodiment thereof illustrated as non-limiting example in the enclosed drawings, in which:

FIG. 3 shows waveforms of the output voltage signal of the circuit of FIG. 1 in the case of driving two columns;

FIG. 4 shows an image formed on the display of an LCD;

FIG. 5 is a circuitry diagram of a system for driving the columns of an LCD according to an embodiment of the invention;

DETAILED DESCRIPTION OF THE PREFERRED EMBODIMENTS

Figure 1:
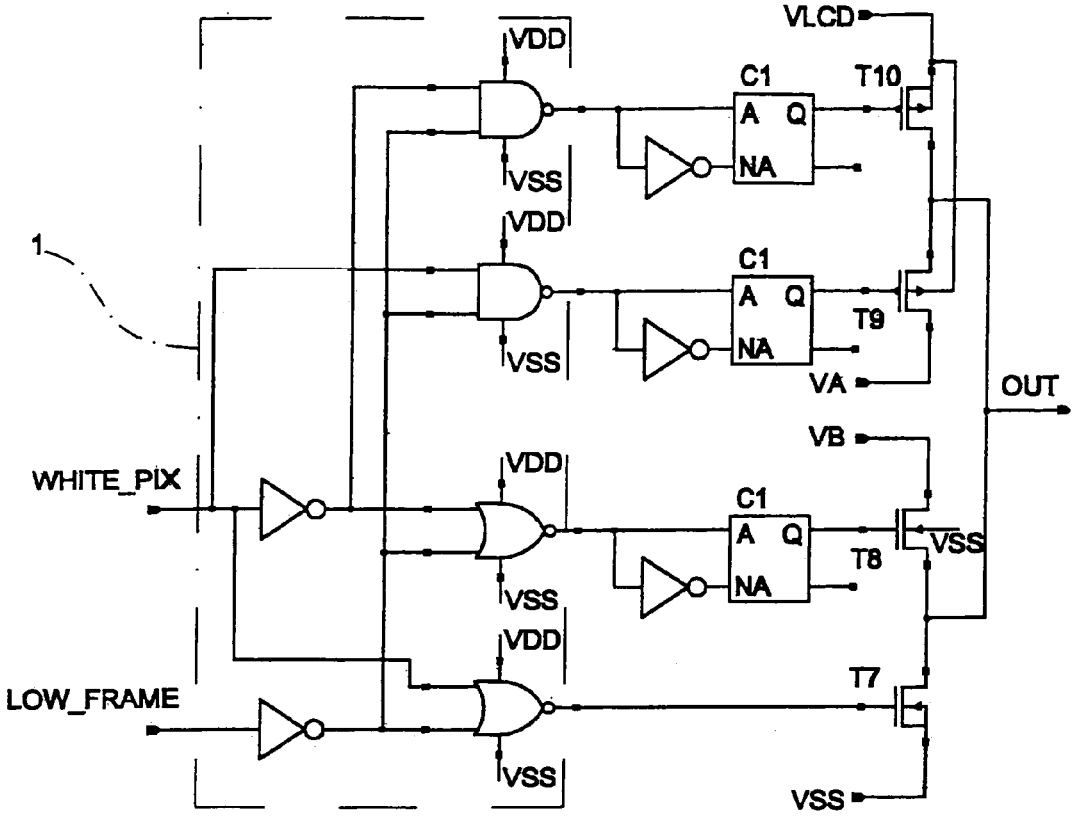
PRIOR ART Fig.1
FIG. 1 is a circuitry diagram of a driving device of columns of an LCD according to the known art.
Figure 2:
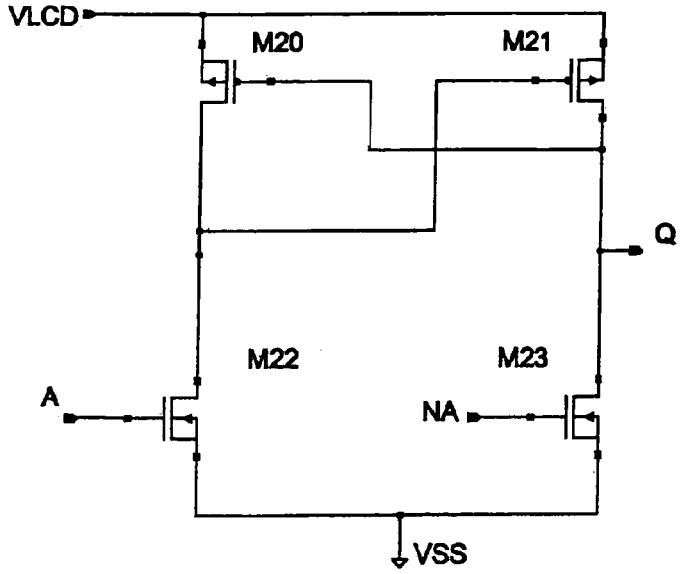
Fig.2 PRIOR ART
FIG. 2 is a more detailed circuitry diagram of a part of the circuit of FIG. 1.

FIG. 5 shows a circuit diagram of a system for driving columns of an LCD according to an embodiment of the present invention. Said device comprises a low voltage logic circuit 10 operating between a supply voltage VDD and a supply voltage VSS, two level-shifters 11 and 12 operating between a supply voltage VLCD supplied by a device comprising a booster regulator through the connection of a certain number of stages of a charge pump (not shown in FIG. 5) and the voltage VSS, a pair of PMOS transistors T11, T12 and a pair of NMOS transistors T13, T14 having different supply paths. The principle on which the invention is based is that in a frame transistors PMOS T11, T12 or both transistors NMOS T13, T14 are never both on. This permits the elimination of a level-shifter in relation to the drive device of FIG. 1, as every level-shifter comprises in addition to the output signal its negated signal, but it is necessary to add circuitry to keep the MOS transistors not involved in the commutation during the abovementioned frame off; a decrease of the current used in the drive device of the columns derives from this. Therefore the device of FIG. 5 also comprises turnoff circuitry 15 capable of generating two signals TR_STATE1 and TR_STATE2 suitable for turning off, alternately through level-shifters 11 and 12, PMOS transistors T11, T12 or NMOS transistors T13, T14 not involved in the commutations with the succession of the frame.

The signal LOW_FRAME is a logic signal that equals zero in the even frames, and equalling one in the uneven frames. WHITE_PIX is a logic signal that equals zero when the pixel has is on, and equalling one when the pixel is off. Starting from these two signals, through circuit 10, the logic signals CP, CP_N, CN, CN_N, suitable for driving the level-shifters 11 and 12 are generated, which in turn drive PMOS transistors T11, T12 and NMOS transistors T13, T14.

Circuit 10 ensures that if the logic signal LOW_FRAME is at the one logic level, the signals CP and CP_N are placed at the zero logic level and the signals CN and CN_N commutate following the commutation of the signal WHITE_PIX; more precisely, the signal CN is in phase with the signal WHITE_PIX while the signal CN_N is the signal CN negated.

Given that the logic signals CP and CP_N are at the zero logic level, the level-shifter 11 that is driven by said signals must be inactive so that PMOS transistors T11 and T12 are off. In this case, the TR_STATE1 signal generated by circuitry 15 keeps level-shifter 11 inactive. NMOS transistors T13, T14 are driven by level-shifter 12, which is operating and the output OUT of the column drive device varies between VSS and VB.

Again, circuit 10 ensures that if the logic signal LOW_FRAME is at the zero logic level, the signals CN and CN_N are placed at the one logic level and the signals CP and CP_N commutate following the commutations of the signal WHITE_PIX; more precisely the signal CP is in phase with the signal WHITE_PIX while the signal CP_N is the signal CP negated.

Given that the logic signals CN and CN_N are at the one logic level, level-shifter 12 that is driven by said signals must be inactive so that NMOS transistors T13 and T14 are off. In this case, the TR_STATE2 signal generated by circuitry 15 keeps level-shifter 12 inactive. PMOS transistors T11, T12 are driven by level-shifter 11 operating and the output OUT of the column drive device varies between VLCD and VA.

Figure 7:
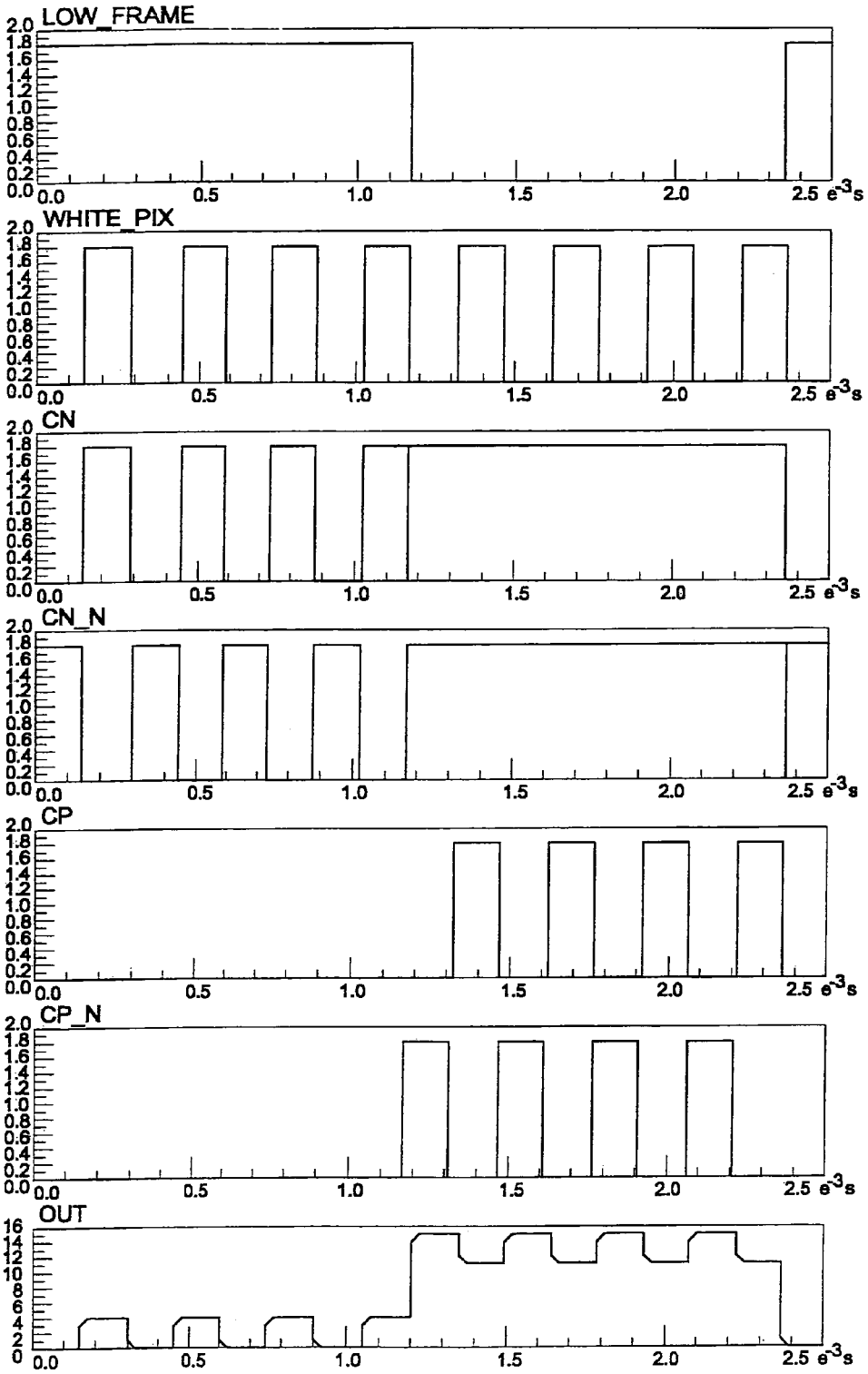
FIG. 7 shows the temporal waveforms LOW_FRAME, WHITE_PIX, CN, CN_N, CP, CP_N and OUT concerning the circuit of FIG. 6.

FIG. 7 shows the temporal diagrams of the signals LOW_FRAME, WHITE_PIX, CN, CN_N, CP, CP_N, OUT that derive from simulations relating to two successive frames, that is an even frame and an uneven frame.

Figure 6:
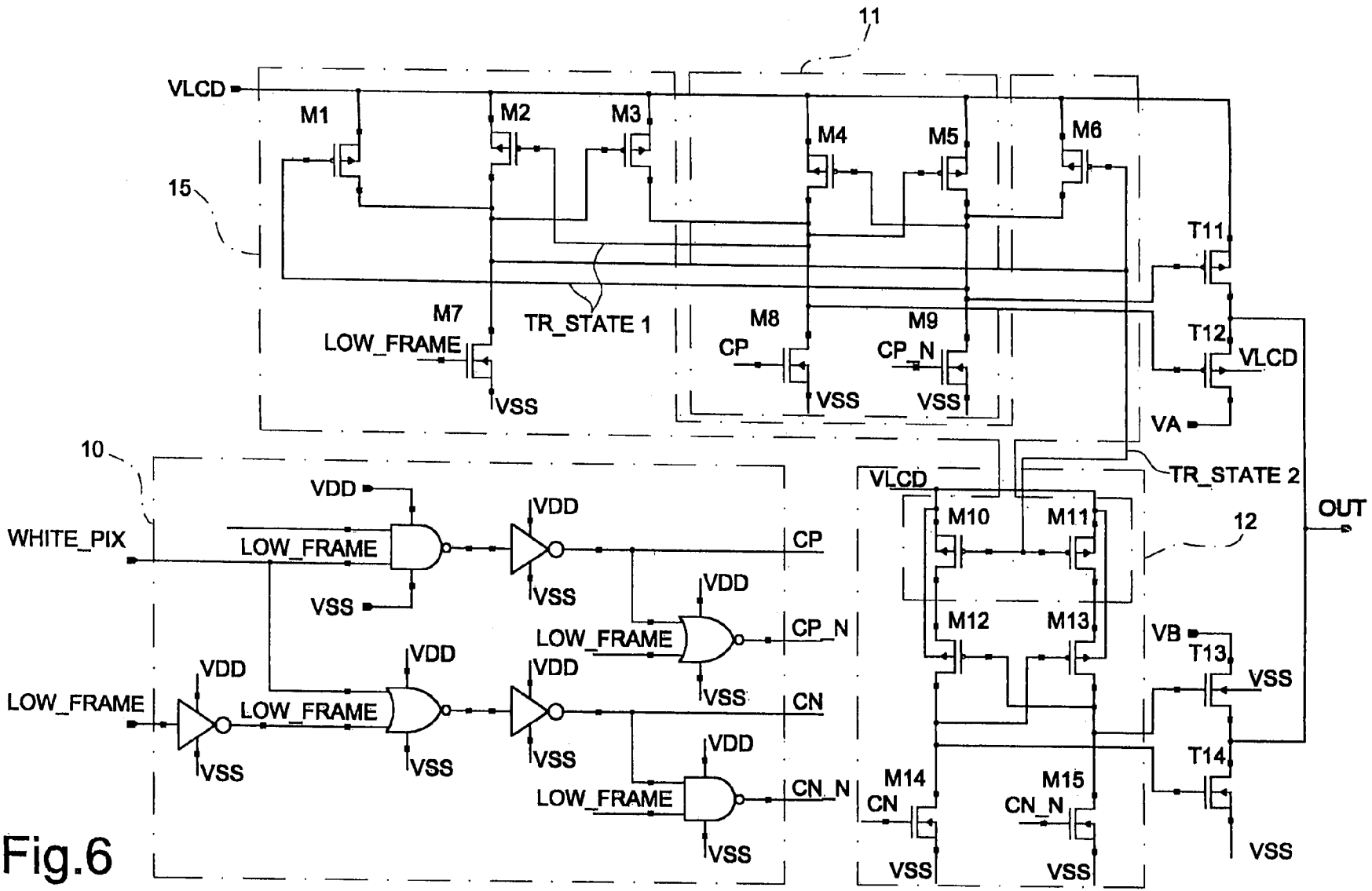
FIG. 6 is a more detailed circuitry diagram of the device of FIG. 5.

FIG. 6 shows the components of the column drive device of FIG. 5 more in detail.

The low voltage logic circuitry 10 comprises several inverters as well as NAND and NOR gates which, starting from the signals WHITE_PIX and LOW_FRAME in input to the circuitry 10 generate the logic signals CP, CP_N, CN, CN_N, suitable for driving level-shifters 11 and 12 and having a voltage value equal to the voltage VDD or to the voltage VSS as shown in FIG. 6.

Device 11 comprises two NMOS transistors M8 and M9 driven by the signals CP and CP_N, whose source terminals are coupled to the voltage VSS and whose drain terminals are coupled respectively to the drain terminals of two PMOS transistors M4 and M5 on the source terminal of which the voltage VLCD is present. The gate terminals of transistors M4 and M5 are coupled to the drain terminals of transistors M9 and M8.

The same drain terminals of transistors M8 and M9 are coupled to the gate terminals of transistors M2 and M1 on the source terminals of which the voltage VLCD is present, and at the drain terminals of transistors M3 and M6 on the source terminals of which the voltage VLCD is present. Transistors M1, M2, M3, M6 belong to turnoff circuitry 15 that also comprises a transistor M7 having its source terminal coupled to the voltage VSS, the drain terminal in common with the gate terminal of transistors M3 and M6 and with the drain terminals of transistors M1 and M2; the signal LOW_FRAME is present on the gate terminal.

Device 12 comprises two NMOS transistors M14 and M15 driven by the signals CN and CN_N whose source terminals are coupled to the voltage VSS and whose drain terminals are coupled respectively to the drain terminals of two PMOS transistors M12 and M13 the gate terminals of which are coupled to the drain terminals of transistors M15 and M14. The source terminals of transistors M12 and M13 are coupled to the drain terminals of two transistors M10 and M11 having the gate terminals in common and the voltage VLCD is present on the source terminals. The gate terminal of transistors M10 and M11 is connected to the gate terminal of transistor M6.

The pair of PMOS transistors T11 and T12 has a supply path between the voltages VLCD and VA while NMOS transistors T13 and T14 has a supply path between the voltages VB and VSS. The gate terminals of transistors T11 and T12 are coupled to the drain terminals of transistors M8 and M9 of device 11, while the gate terminals of transistors T13 and T14 are coupled with the drain terminals of transistors M15 and M14 of device 12. The common output terminal of transistors T11 and T12 is coupled to the common output terminal of transistors T13 and T14 and represents the output terminal OUT of the drive device of the present invention.

Circuit 10 ensures that, as can be seen in FIG. 6, if the logic signal LOW_FRAME is at the one logic level, the signals CP and CP_N are placed at the zero logic level and the signals CN and CN_N commutate following the commutations of the signal WHITE_PIX; more precisely, the signal CN is in phase with the signal WHITE_PIX while the signal CN_N is the signal CN negated.

With the logic signals CP and CP_N at the zero logic level, level-shifter 11 is inactive and PMOS transistors T11 and T12 are off. In fact, transistor M7 is on and causes transistors M3 and M6 to turn on as it brings the voltage on their gate terminals at VSS; in this manner, the voltage on the gate terminals of the transistors T11 and T12 is brought to a voltage that is substantially the same as VLCD by transistors M3 and M6. The turning on of transistor M7 causes transistors M10 and M11 to turn on, bringing the voltage on the source terminals of transistors M12 and M13 substantially the same as VLCD. In this case, the TR_STATE1 signal generated by circuitry 15 is high and keeps level-shifter 11 inactive; the TR_STATE2 signal is low and permits device 12 to turn on. The NMOS transistors T13, T14 are driven by level-shifter 12 operating and the output OUT of the column drive device varies between VSS and VB.

Again, circuit 10 ensures that if the logic signal LOW_FRAME is at the zero logic level, the signals CN and CN_N are placed at the one logic level and the signals CP and CP_N commutate following the commutations of the signal WHITE_PIX; more precisely, the signal CP is in phase with the signal WHITE_PIX while the signal CP_N is the signal CP negated.

With the logic signals CN and CN_N at the one logic level, level-shifter 12 is inactive and NMOS transistors T13 and T14 are off. In fact, transistor M7 is off and the turning on of one of transistors M8 or M9 causes one of transistors M2 or M1 to turn on as it brings the voltage on their gate terminals to VSS; in this manner, the voltage on one of the gate terminals of transistors T11 and T12 is brought to a voltage which is substantially equal to VSS. The turning on of one of transistors M1 or M2 causes transistors M3 and M6 to turn off and transistors M10 and M11 that inhibit the turning on of device 12 and of transistors T13 and T14 to turn off. In this case, the TR_STATE2 signal generated by circuitry 15 is high and keeps level-shifter 12 inactive; the TR_STATE1 signal is low and permits device 11 to turn on. The PMOS transistors T11, T12 are driven by level-shifter 11 operating and the output OUT of the column drive device varies between VLCD and VA.

While there have been described above the principles of the present invention in conjunction with a specific circuit and timing implementation it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features which are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The applicants hereby reserve the right to formulate new claims to such features and/or combinations of such features during the prosecution of the present application or of any further application derived therefrom.

The invention claimed is:

1. A system for driving columns of a liquid crystal display comprising:

logic circuitry operating in a supply path between a first and a second supply voltage with said first supply voltage higher than said second supply voltage, said logic circuitry being capable of generating first logic signals and second logic signals whose value is equal to said first or second supply voltage;

elevator devices coupled to said logic circuitry and operating in a supply path between a third supply voltage greater than said first supply voltage and said second supply voltage, said elevator devices being capable of raising the value of said second logic signals;

a first and a second pair of transistors having different supply paths and having an output terminal in common, said first and second pair of transistors being associated with said elevator devices and said logic circuitry to determine the drive signal of a column, wherein said elevator devices are coupled to one of said pairs of transistors; and turnoff circuitry coupled to said elevator devices, said turnoff circuitry being capable of keeping one of said two pairs of transistors in the turnoff state in the period of time of a frame when the other of said two pairs of transistors is operative.

2. The system according to claim 1, wherein said turnoff circuitry operates in a supply path between said third and said second supply voltage.

3. The system according to claim 1, wherein each of said elevator devices separately drives the transistors of one of said pairs of transistors.

4. The system according to claim 3, wherein said turnoff circuitry one of said first logic signals changes value in response to an even frame or an uneven frame.

5. The system according to claim 4, wherein said turnoff circuitry sends two signals complementary with each other respectively to said elevator devices according to the state of one of said first logic signals to inhibit the turning on of one of the elevator devices.

6. The system according to claim 5, wherein said pairs of transistors comprise pairs of MOS transistors.

7. They system according to claim 6, wherein said pairs of MOS transistors comprise a pair of PMOS transistors and a pair of NMOS transistors, and said elevator devices each comprise a first and a second NMOS transistor driven by two of said second logic signals complementary between each other and a first and a second PMOS transistor having terminals that can be driven coupled respectively with the drain terminal of said second and first NMOS transistors, the drain terminals coupled respectively with the drain terminals of said first and second NMOS transistors, and the source terminals coupled to said third supply voltage.

8. The system according to claim 7, wherein said turnoff circuitry comprises a first transistor having a gate terminal driven by said one of first logic signals and having a first non-driven terminal coupled to said second supply voltage and a second non-driven terminal coupled to non-driven terminals of two additional transistors having a first non-driven terminal coupled respectively with the drain terminals of said first and second NMOS transistor of one of said elevator devices and a second non-driven terminal coupled to said third supply voltage, the non-driven terminal of said two additional transistors being coupled to the non-driven terminal in common with two more additional transistors having first non-driven terminals respectively coupled to the source terminals of said first and second PMOS transistor of one of said elevator devices and the other non-driven terminal coupled to the third supply voltage, said turnoff circuitry comprising two more additional transistors having non-driven terminals respectively coupled to the drain terminals of said first and second NMOS transistor of one of said elevator devices, first non-driven terminals coupled to said additional non-driven terminal of said first transistor and second non-driven terminal coupled to said third supply voltage.

* * * * *

UNITED STATES PATENT AND TRADEMARK OFFICE

CERTIFICATE OF CORRECTION

PATENT NO. : 7,259,743 B2
APPLICATION NO. : 10/518614
DATED : August 21, 2007
INVENTOR(S) : Salvatore Pappalardo et al.

It is certified that error appears in the above-identified patent and that said Letters Patent is hereby corrected as shown below:

On the title page, item [73]: Assignee, after "STMicroelectronics S.r.l., Agrate Brianza (MI) (IT)" insert --DORA S.p.A, Aosta (IT)--

Signed and Sealed this

Twenty-ninth Day of April, 2008

JON W. DUDAS
*Director of the United States Patent and Trademark Office*